US007984685B1

(12) United States Patent
Buescher

(10) Patent No.: US 7,984,685 B1
(45) Date of Patent: Jul. 26, 2011

(54) NEUTRALLY BUOYANT SUBMERGED SYSTEM USING GREATER DENSITY BALLAST FLUID

(75) Inventor: James Buescher, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 168 days.

(21) Appl. No.: 12/469,827

(22) Filed: May 21, 2009

(51) Int. Cl.
*B63G 8/14* (2006.01)

(52) U.S. Cl. ..... 114/330; 114/121

(58) Field of Classification Search ..... 114/121, 114/125, 330, 333
See application file for complete search history.

(56) References Cited

U.S. PATENT DOCUMENTS 2,887,977 A * 5/1959 Piry ..... 114/333
3,343,511 A * 9/1967 Hinton et al. ..... 114/330
3,379,156 A * 4/1968 Keays et al. ..... 114/333
3,437,065 A 4/1969 Robbins
4,448,145 A * 5/1984 Hervieu ..... 114/331

* cited by examiner

*Primary Examiner* — Lars A Olson

(74) *Attorney, Agent, or Firm* — Kyle Eppele; Stephen E. Baldwin

(57) ABSTRACT

The system provides a means by which the attitude or orientation of a submerged object can be changed using a fixed quantity of transferable ballast fluid which has a density greater than that of the surrounding fluid in which the object is submerged. In one embodiment, the process utilizes a static flotation shell offset the net negative buoyancy of the transferable ballast fluid. In this way, the total overall buoyancy of the system does not change, but by transferring fluid into expandable reservoirs which are physically separated from the static flotation shell, the separation between the center of buoyancy and the center of mass of the object can be changed, and thus the attitude or orientation of the object, if it is unrestrained, may be changed.

7 Claims, 3 Drawing Sheets

NEUTRALLY BUOYANT SUBMERGED SYSTEM USING GREATER DENSITY BALLAST FLUID

FEDERALLY-SPONSORED RESEARCH AND DEVELOPMENT

This invention (Navy Case No 99596) is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-2778; email T2@spawar.navy.mil.

BACKGROUND OF THE INVENTION

Previous methods for modifying the attitude of submerged objects have involved (a) the shifting of non-fluid mass within the submerged object to alter the position of the center of mass, or by (b) dynamic lifting surfaces or thrusters which require relative velocity of the submerging fluid to exert external forces on the object and change its attitude. Alternatively (c) inflatable or floodable volumes may be used to displace or ingest quantities of submerging fluid from a submerged object, thus changing the object's total volume, center of buoyancy, and attitude.

Of the above described previous methods, (a) is impractical for very large or non-rigid submerged objects because of the practical issues of re-positioning non-fluid mass within the object. Further, objects which are not large enough to internally house repositionable masses are limited by that approach. Method (b) is impractical for objects which are or must remain static in the submerged fluid, which is to say those which are not moving or cannot move, and method (c) is impractical for systems which cannot afford an overall change in net buoyancy in order to achieve attitude modification.

SUMMARY

The system provides an apparatus for changing the attitude of an object immersed in a surrounding fluid. The system comprises a first expandable reservoir, a second, separate expandable reservoir where the second expandable reservoir is contained within a fixed volume of a static flotation shell. The object has a passively stable orientation and an initial center of mass and buoyancy and a net neutral buoyancy. The system includes a flexible conduit for transferring a ballast fluid which is greater in density than the submerging fluid between the first and second reservoirs. The first and second reservoirs and the flexible conduit contain a fixed quantity of the ballast fluid. The system further includes a pump mechanism for controllably transferring the ballast density fluid between the first and second reservoirs via the flexible conduit to provide another passively stable orientation of the object with a new center of mass and buoyancy but with an unchanged net neutral buoyancy, thereby controllably changing the attitude of the submerged object.

BRIEF DESCRIPTION OF THE DRAWINGS

Throughout the several views, like elements are referenced using like references.

DETAILED DESCRIPTION OF THE EMBODIMENTS

The invention provides a means by which the attitude or orientation of a submerged object can be changed or altered using a fixed quantity of transferable or ballast fluid which has a density greater than that of the surrounding fluid in which the object is submerged. In one embodiment, the process utilizes a static flotation shell (which could be closed-cell foam) to offset the net negative buoyancy of the transferable ballast fluid. In this way, the total overall buoyancy of the system does not change, but by transferring ballast fluid into expandable reservoirs which are physically separated from the static flotation shell, the separation between the center of buoyancy and the center of mass of the object can be changed, and thus the attitude or orientation of the object, if it is unrestrained, may be changed.

Figure 1:
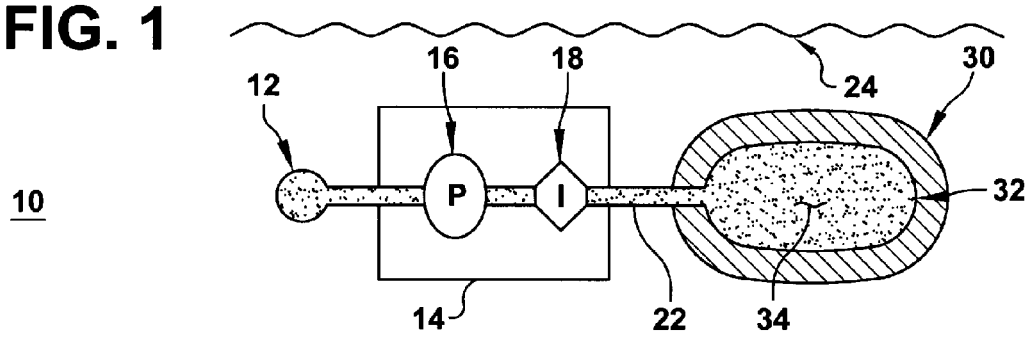
FIG. 1 shows a side view of one attitude or orientation of the present system.

In FIG. 1, an underwater object 10 includes a first expandable reservoir 12 connected to a pump mechanism 16 capable of transferring ballast fluid 34, which is gated by a valve 18 and connected at its opposite end to a second, separate expandable reservoir 32. Pump 16 and valve 18 can be contained within a control unit 14, for purposes of providing a remote control capability of controllably transferring ballast fluid 34 between the reservoirs 12 and 32 via a flexible conduit 22.

Reservoirs 12, 32 are typically an elastomeric (rubber) type material which can be suitably expanded. One type of reservoir which could be utilized with the system 10 of FIG. 1 is an elastomeric rolling diaphragm from Bellofram Corporation. The flexible conduit 22 could be a flexible polyurethane hose, known as Tygon tubing.

Reservoir 32 is contained (located) within a fixed volume of static flotation shell 30 and the whole system 10 is filled with a fixed quantity of heavy transferable or ballast fluid 34, which is greater in density than the surrounding fluid 24. The ballast fluid 34 could be Fluorinert, a liquid greater in density than the surrounding fluid 24, which in this instance is water. Fluorinert is available from 3M Company. In FIG. 1, the whole object 10 is surrounded by and submerged in fluid 24. The inside of the flotation shell 30 is free to flood with submerging fluid 24.

In the first configuration, shown by FIG. 1, the reservoir 32 contains enough fluid 34 to exactly offset the static flotation shell 30. The object 10 is assumed to be neutrally buoyant and passively stable in this orientation.

Figure 2:
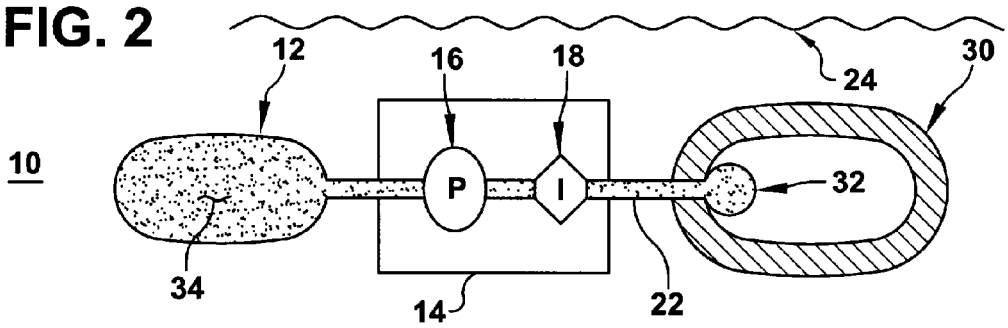
FIG. 2 shows another side view of the present system in which the attitude or orientation is changing.

FIG. 2 shows the system 10 when it is in the process of changing attitude. The gate valve 18 has been opened, and the pump 16 has transferred a quantity of fluid 34 to the expandable reservoir 12 which is not collocated with offsetting static flotation shell 30. It should be understood that the control unit 16, containing the pump mechanism 16 and valve 18, could be remotely controlled, to provide a remotely controlled gated pump valve mechanism.

Figure 3:
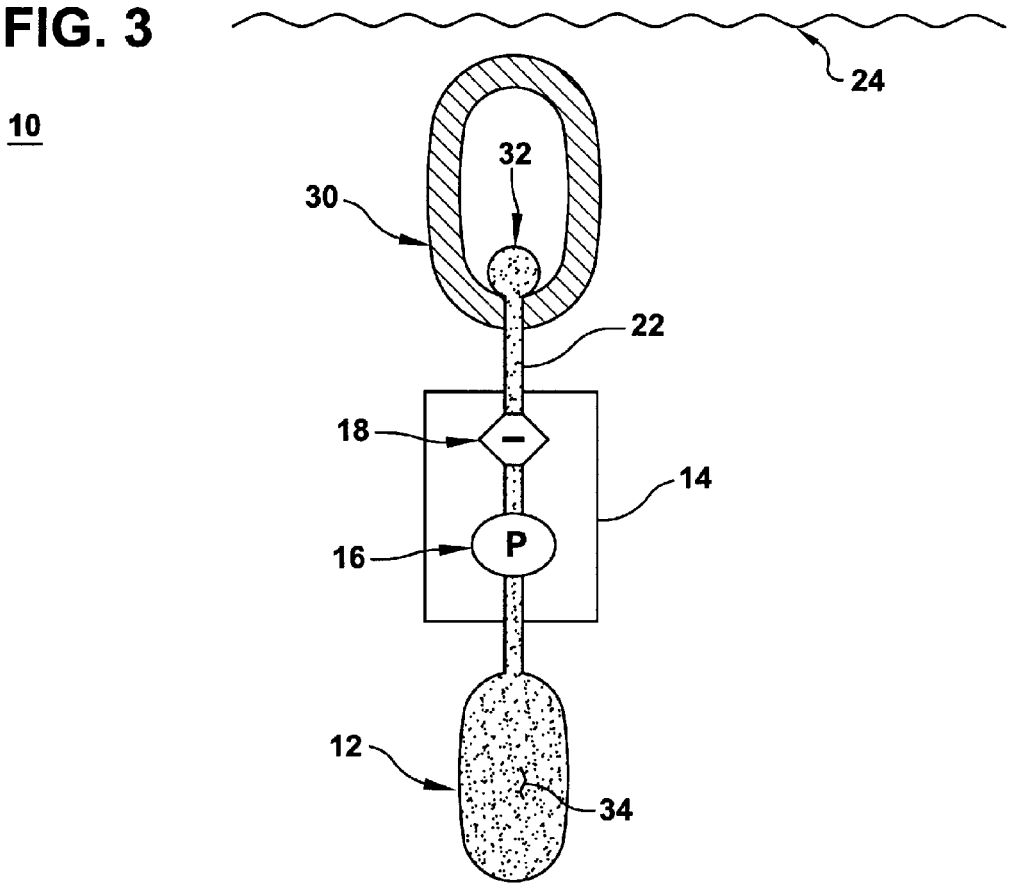
FIG. 3 shows another side view of the present system in which the attitude or orientation has changed.

FIG. 3 shows the system 10 after attitude has changed. The gate valve 18 is now closed, and the static flotation 32 has floated upward in the surrounding fluid 24 to achieve alignment of the new center of buoyancy of object 10 with the new center of mass of object 10. The object 10 is now passively stable in this orientation, and the total net buoyancy of the object 10 is unchanged from FIG. 1.

The process can be reversed, and by pumping all of the transfer fluid 34 back into reservoir 32, the attitude of the object can be reverted to that shown in FIG. 1.

Figure 4:
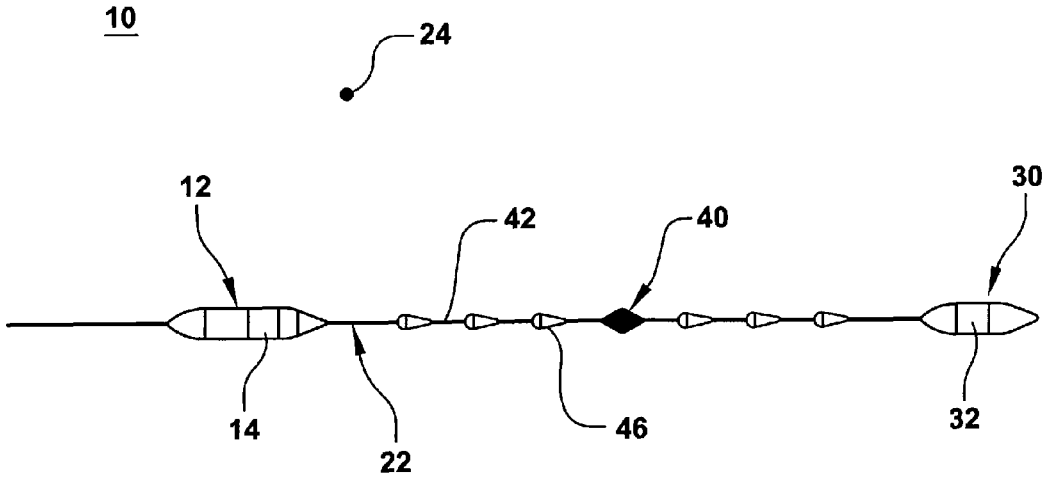
FIGS. 4 and 5 show the basic components of a non-rigid array of the present system which is submerged in water.
Figure 5:
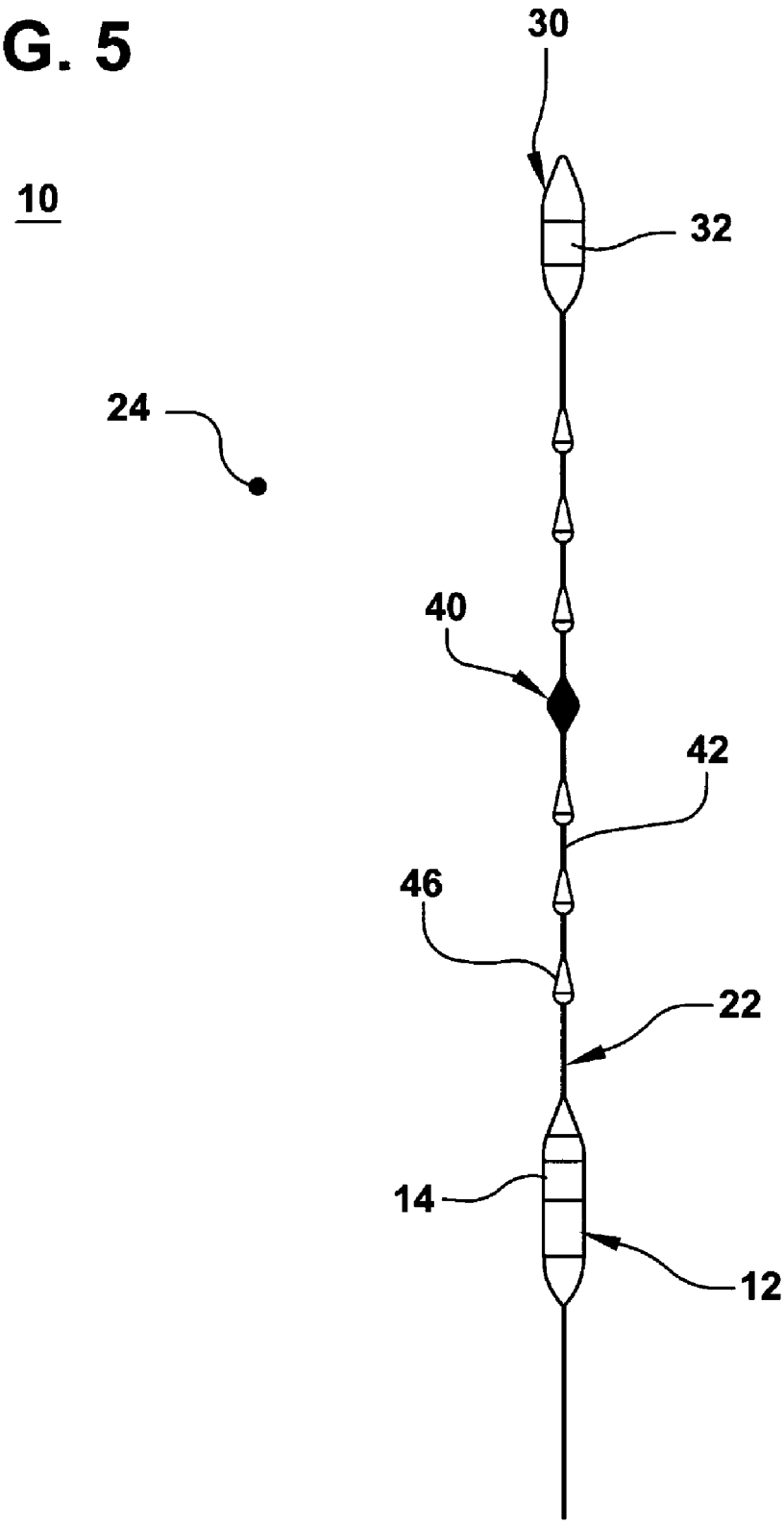

In one embodiment, the system 10 is can change the attitude of an object, such as an array of sensor elements shown in FIGS. 4-5. The array of sensor elements shown in FIGS. 4-5 is normally submerged in water and intended to have two separate attitudes which may be selected by changing or modifying the attitude of the object through the transfer of a ballast fluid, as previously described. These configurations approximate a horizontal (or level) attitude, as shown in FIG. 4, and a vertical (or upright) attitude as shown in FIG. 5.

FIGS. 4 and 5 show the basic components of a non-rigid array system 10 which is submerged in water 24. The array system 10 includes a flexible conduit cable 22 which is connected between reservoir 12 and reservoir 32/flotation shell 30. The transfer of a ballast fluid between reservoir 12 and reservoir 32 is controlled by pump mechanism 14, as previously described An arbitrary number of sensor elements 40 may be located on the array 10 to collect and transmit information via separate cable 42, as well as an arbitrary number of flotation elements 46. The system 10 can be applied to sensor arrays such as a DADS (Deployable Autonomous Distributed System) array, as well as other objects, such as a rigid beam or the hull of a submarine, as examples.

The method described by this invention has the advantage of working for rigid as well as non-rigid submerged bodies, so long as the expandable reservoirs can be connected by flexible conduit. System 10 transfers heavy fluids to change the center of mass, center of buoyancy, and attitude of submerged objects. The system 10 works to change attitude of a submerged object even when the object is completely static in the submerging fluid. The invention can be applied externally to pre-existing submerged objects which may be of small or unusual shape, or unsuitable for internal modification. The invention does not cause any net negative or positive gain in total buoyancy.

From the above description of the Neutrally Buoyant Submerged System Using Greater Density Ballast Fluid, it is apparent that various techniques may be used for implementing the concepts of system 10 without departing from its scope. The described embodiments are to be considered in all respects as illustrative and not restrictive. It should also be understood that system 10 is not limited to the particular embodiments described herein, but is capable of many embodiments without departing from the scope of the claims.

What is claimed is:

1. Apparatus for changing the attitude of an object immersed in a surrounding fluid comprising a first expandable reservoir, a second, separate expandable reservoir, the second expandable reservoir contained within a fixed volume of a static flotation shell, the shell being initially flooded with surrounding fluid to provide initial static flotation of the object having a passively stable orientation and having an initial center of mass and buoyancy and a net neutral buoyancy, a flexible conduit for transferring a ballast fluid which is greater in density than the surrounding fluid between the first and second reservoirs, the first and second reservoirs and the flexible conduit containing only a fixed quantity of the ballast fluid, a pump mechanism for controllably transferring the ballast fluid between the first and second reservoirs via the flexible conduit to provide another passively stable orientation of the object with a new center of mass and buoyancy but with an unchanged net neutral buoyancy, thereby controllably changing the attitude of the immersed object.

2. The apparatus of claim 1 wherein the pump mechanism is remotely controlled.

3. The apparatus of claim 1 wherein the object is rigid.

4. The apparatus of claim 1 wherein the object is resilient.

5. The apparatus of claim 1 wherein the surrounding fluid is water.

6. Apparatus for changing the attitude of an object immersed in a surrounding fluid comprising a first expandable reservoir a second, separate expandable reservoir, the second expandable reservoir contained within a fixed volume of a static flotation shell, the shell being initially flooded with surrounding fluid to provide initial static flotation of the object having a first center of mass and buoyancy and net neutral buoyancy, a remotely controllable gated valve pump mechanism for controlling fluid transfers between the first and second reservoirs via a flexible conduit, the second reservoir containing a sufficient quantity of a transferable ballast fluid which is greater in density than the surrounding fluid to offset the static flotation of the object so that the object is neutrally buoyant and passively stable, the gated valve pump mechanism controllably transferring the ballast fluid from the second reservoir to the first reservoir via the flexible conduit such that the static flotation shell floats upward in the surrounding fluid to achieve alignment with a modified center of mass and buoyancy of the object to provide a passively stable orientation of the object with an unchanged net neutral buoyancy, thereby controllably changing the attitude of the immersed object.

7. Apparatus for changing the attitude of an unrestrained object immersed in water comprising a first expandable reservoir, a second, separate expandable reservoir, the second expandable reservoir contained within a fixed volume of a static flotation shell, the shell being initially flooded with surrounding fluid to provide initial static flotation of the object, a flexible conduit for transferring a ballast density fluid between the first and second reservoirs, the first and second reservoirs and the flexible conduit containing only a fixed quantity of the ballast fluid which is greater in density than the surrounding water, a pump mechanism for controllably transferring the ballast density fluid between the first and second reservoirs via the flexible conduit to controllably change the attitude of the unrestrained, immersed object.

* * * * *